US006714845B2

(12) United States Patent
Pinkos et al.

(10) Patent No.: US 6,714,845 B2
(45) **Date of Patent: *Mar. 30, 2004**

(54) METHOD AND APPARATUS FOR INTERCEPTING AN EVADING TARGET ALERTED AT SEEKER TURN-ON

(75) Inventors: Robert F. Pinkos, Saunderstown, RI (US); Anthony F. Bessacini, Narragansett, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 43 days.

This patent is subject to a terminal disclaimer.

(21) Appl. No.: 10/077,711

(22) Filed: Feb. 14, 2002

(65) Prior Publication Data

US 2003/0154006 A1 Aug. 14, 2003

(51) Int. Cl.[7] ..... G06F 17/00
(52) U.S. Cl. ..... 701/23; 244/3.1

(58) Field of Search ..... 701/23, 1, 24, 701/27, 302; 244/3.1, 3.11, 3.14, 3.15, 3.16, 3.19

(56) References Cited

U.S. PATENT DOCUMENTS 6,006,145 A * 12/1999 Bessacini ..... 701/1

* cited by examiner

*Primary Examiner*—William A. Cuchlinski, Jr.
*Assistant Examiner*—Olga Hernandez

(57) ABSTRACT

A method and apparatus for directing a pursuing vehicle, such as a torpedo, on an intercept trajectory from a launching vehicle to a target vehicle with evasion capabilities and the target vehicle is alerted to pursuing vehicle at the time that the pursuing vehicle enables its seeker. Models of the pursuing vehicle and evading target provide proposed trajectories based upon various environmental considerations. A guidance system uses estimates of initial operating parameter solutions for the pursuing vehicle, such as gyro angle, intercept time and run-to-enable time, to begin a convergent, iterative process that defines final operating parameter solutions from which the guidance parameters are determined and transferred to the pursuing vehicle at launch.

14 Claims, 7 Drawing Sheets

METHOD AND APPARATUS FOR INTERCEPTING AN EVADING TARGET ALERTED AT SEEKER TURN-ON

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

This invention generally relates to trajectory control and more specifically to a method and apparatus for providing guidance parameters at launch that direct a pursuing vehicle from a launching vehicle to a target vehicle capable of evasive maneuvering when the target vehicle becomes alerted to the presence of the pursuing vehicle at when the pursuing vehicle enables its seeker mechanism.

(2) Description of the Prior Art

The trajectory control of a pursuing vehicle can be classified as post-launch or pre-launch control. In post-launch control, guidance information is sent from the launching vehicle to guide the pursuing vehicle to the target vehicle.

More specifically, in prior art post-launch control systems, a pursuing vehicle exits a launching vehicle. Control systems on the launching vehicle monitor the relative positions of the pursuing vehicle and a target vehicle or contact and control the pursuing vehicle by the transfer of information between the launching vehicle and the pursuing vehicle over a communications link. When the launching vehicle is a submarine and the pursuing vehicle is a torpedo, the communications link typically comprises a communications wire. If the pursuing vehicle is a missile the communications typically occurs over some radio link. In either case, post-launch control systems on the launching vehicle issue guidance parameters to guide the pursuing vehicle along some trajectory into a predetermined relationship with the target vehicle.

In a pre-launch system, the pursuing vehicle follows a predetermined trajectory after launch that may or may not be programmable prior to launch. However, with either type, the pursuing vehicle leaves the launching vehicle and travels along a trajectory that may be simple or complicated. With torpedoes, missiles and the like that may undergo pre-programmed maneuvers, the input guidance parameters may include gyro angles and time lapses or run distances computed from these time lapses, including, for example, the time lapse between the launch and the enablement of any instrumentation on the pursuing vehicle, such as an acoustic seeker on a torpedo.

In order to provide the most accurate pre-launch guidance parameters to the pursuing vehicle, it is necessary that the interval between the time a last estimate of target vehicle state is made and the time a pursuing vehicle is launched be quite short. It is during this interval that a prior art pre-launch system must produce the guidance parameters, and this interval has constrained the nature of the analysis required to produce such guidance parameters. For example, prior art pre-launch systems generally assume that the target will maintain a constant velocity even after the target becomes alerted to the presence of the pursuing vehicle. In actual practice, however, a target normally takes evasive action by turning, changing speed or both. Some prior art pre-launch systems take such actions into account by launching two or more pursuing vehicles along the calculated course and one or more offset courses.

U.S. Pat. No. 5,828,571 (1998) to Bessacini et al. discloses a method and apparatus that overcomes many of the foregoing problems and deficiencies. This method and apparatus provide pre-launch guidance parameters within a short time interval and take evasive action of a target vehicle into account. Models of the pursuing vehicle and target vehicle provide proposed trajectories based upon various environmental considerations and possible evasive tactics. A guidance system uses estimates of initial operating parameter solutions, such as gyro angle, alertment time and intercept time, to begin a convergent, iterative process that defines final operating parameter solutions from which the guidance parameters are determined and transferred to the pursuing vehicle at launch.

In accordance with the method and apparatus disclosed in U.S. Pat. No. 5,828,571 an operator enters an evasive action as an initial parameter that can be independent of the tactical situation facing the target vehicle. That is, the selection of a particular evasive action is somewhat arbitrary or subjective because the selection is primarily dependent on the experience of an operator at the launching vehicle. While the operator may guess the general nature of an evasive action, the operator determines the evasive action without knowledge, for example, of the actual bearing from the target vehicle to the pursuing vehicle at alertment. However, in general, the target vehicle will base an actual evasive action upon that bearing. The evasive actions that the operator guesses and the target vehicle takes may be the same in general terms; for example, a turn of 90°. However, the actual courses will differ if the base line for the operator's guess is not the bearing on which the actual evasive action is based. Moreover, in some situations, bearing from the target vehicle to the pursuing vehicle might actually dictate an entirely different evasive action from that selected by the operator on the launching vehicle even though only a small difference exists in the situation perceived by the operator in advance and at the target vehicle at alertment.

More recently, and as disclosed in our U.S. Pat. No. 6,006,145 (1999) a pursuing vehicle, such as a torpedo, is placed on an intercept trajectory from a launching vehicle to a target vehicle with evasion capabilities. Models of the pursuing vehicle and evading target provide proposed trajectories based upon various environmental considerations. A guidance system uses estimates of initial operating parameter solutions, such as gyro angle, alertment time and intercept time, to begin a convergent, iterative process that defines final operating parameter solutions from which the guidance parameters are determined and transferred to the pursuing vehicle at launch. During each iteration, the solution determines an alertment time and an alertment bearing from the target vehicle to the pursuing vehicle at the alertment time. A selected evasive strategy includes a turn that is calculated relative to the alertment bearing.

As more clearly described in the above-identified U.S. Pat. No. 6,006,145 the firing solutions assume that the target becomes alerted when a pursuing vehicle comes within a predefined alertment range. This range constrains the solution provided by that method and apparatus as a set of non-linear equations as solved for three unknowns, namely: (1) gyro turn, (2) intercept time and (3) alertment time wherein the alertment time depends upon a priori knowledge of alertment ranges.

However, there are certain tactical situations in which it is likely that the target vehicle will only become aware of a pursuing vehicle launch when it is enabled. For example, if the pursuing vehicle is a torpedo, the target vehicle may not become aware of the torpedo's presence until the torpedo enables its active sensors. This is known as "enablement". In this particular situation the solution provided by U.S. Pat. No. 6,006,145 is not valid for two reasons. First, no alertment range can be given; it is only possible to define an alertment time. However, that is the enable time. Second, the alertment range is no longer constrained within the computational loop. As many tactical situations will involve such a situation, it becomes important that any method of obtaining a firing solution take such a situation into account.

SUMMARY OF THE INVENTION

Therefore it is an object of this invention to provide a control method and apparatus for producing guidance parameters for use by a pursuing vehicle at launch that take into account diverse potential evasive maneuvers of a target vehicle.

Another object of this invention is to provide a control method and apparatus for providing guidance parameters to a pursuing vehicle for use at launch that take into account situations in which the target vehicle does not become aware of the pursuing vehicle until enablement.

Yet another object of this invention is to provide a control method and apparatus for providing guidance parameters to a pursuing vehicle for use at launch a short interval after a launching vehicle obtains an estimate of target vehicle state for producing an intercepting trajectory to a target that is not alerted to the presence of the pursuing vehicle until enablement and thereafter takes evasive action.

In accordance with one aspect of this invention, a control method for directing a pursuing vehicle from a launching vehicle to a target vehicle by supplying, to guidance means in the pursuing vehicle, operating parameters prior to the launch. The pursuing vehicle includes means that are enabled after launch; and the target vehicle becomes alerted to the presence of the pursuing vehicle upon the enablement of those means. The control method includes the steps of generating a representation of a characteristic trajectory from a generic model of pursuing vehicle trajectory, generating, in response to data from the identification means, a representation of a characteristic trajectory from a generic model of target vehicle trajectory including the expected enablement range and a plurality of possible evasive actions for the target vehicle, providing initial values for operating parameters. Then the method iteratively propagates the characteristic trajectories to intercept in response to the initial values of the operating parameters according to a plurality of approximation relationships until the solutions converge. The method also includes the steps of selecting a target vehicle evasive maneuver, and transferring the operating parameters that produce the convergence to the pursuing vehicle guidance means.

In accordance with another aspect of this invention a control system directs a pursuing vehicle from a launching vehicle to a target vehicle by supplying, to guidance means in the pursuing vehicle, guidance parameters prior to launching wherein the launching vehicle includes identification means for establishing predetermined target vehicle operating characteristics. The pursuing vehicle includes sensors that are activated at the run-to-enable time. The target vehicle becomes alerted to the pursuing vehicle when the sensors are enabled. The control system generates a representation of a characteristic trajectory from a generic model of pursuing vehicle trajectory and, in response to data from the identification means, a representation of a characteristic trajectory from a generic model of target vehicle trajectory including a plurality of evasive maneuvers. Initial values for the operating parameters are provided to the control system. The control system then iteratively propagates the characteristic trajectories in response to the initial operating parameters according to a plurality of approximation relationships until the solutions converge. An alertment range from the target vehicle to the pursuing vehicle at the run-to-enable time is calculated. The control system also determines course changes as a result of an evasive maneuver by the target submarine. The operating parameters that produce the convergence are transferred to the pursuing vehicle guidance means.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
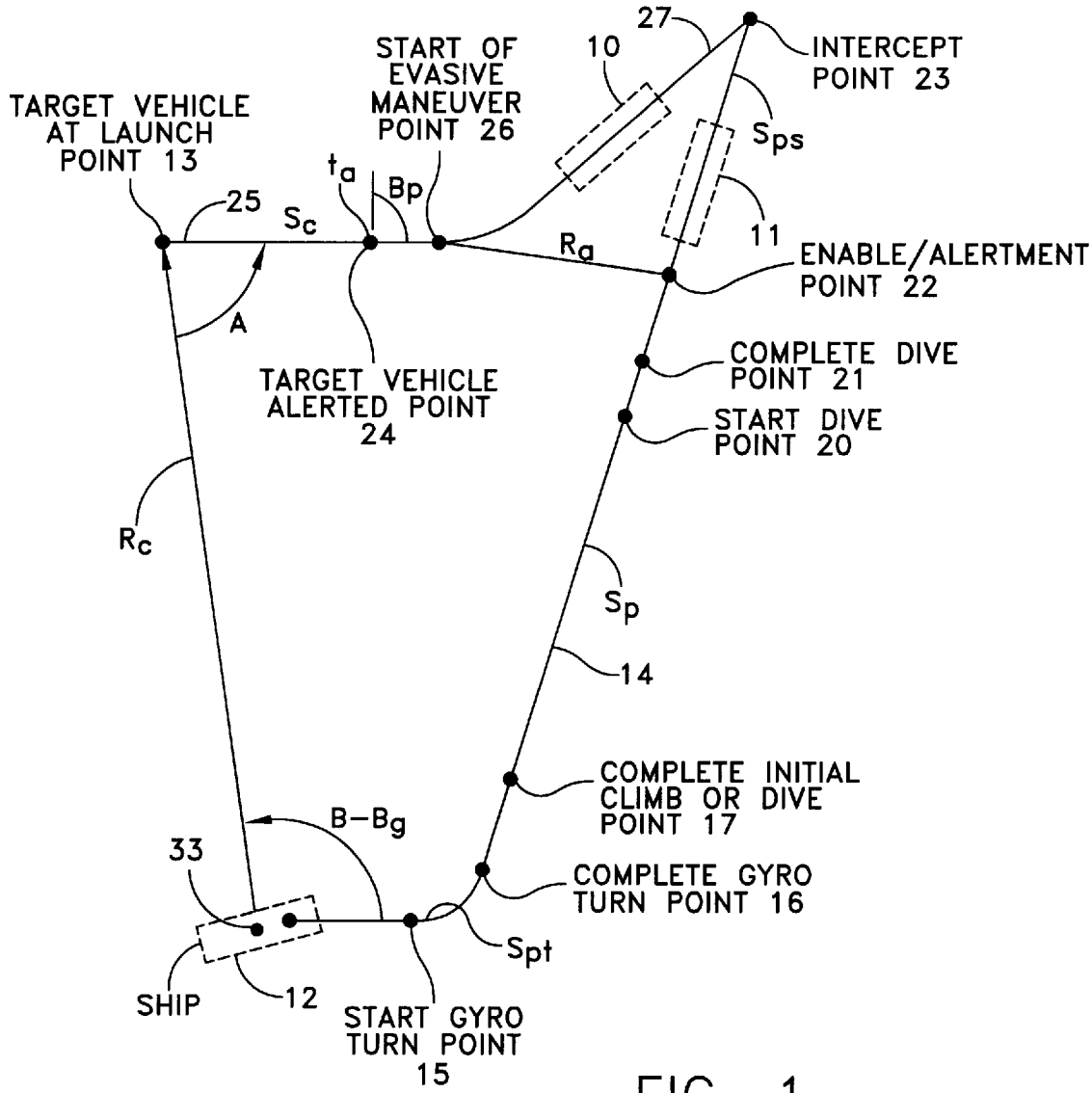
FIG. 1 depicts particular trajectories of a target vehicle and pursuing vehicle on an intercept trajectory.

FIG. 1 depicts typical trajectories of a target vehicle 10 that has the capability of maneuvering evasively and a pursuing vehicle 11 that has an acoustic sensor. Typically it is assumed that at some point in time a launching vehicle 12 detects the presence of a target vehicle 10 and determines current target vehicle state at a point 13. Target vehicle state includes the bearing and range to the target vehicle and its course and speed. After the pursuing vehicle 11 leaves the launching vehicle 12, it travels along a path 14 that is defined by guidance operating parameters supplied just prior to launch. These operating parameters establish the point at which the pursuing vehicle 11 completes a gyro turn onto an intercept trajectory at point 16, the point of the completion of an initial climb or dive at point 17. Then the pursuing vehicle 11 may begin and complete a second dive at points 20 and 21 respectively. If the pursuing vehicle 11 contains some instrumentation, such as an acoustic seeker, that instrumentation activates at an enable point 22; and the pursuing vehicle 11 continues along the path 14 to an intercept point 23.

As previously indicated, this invention is directed to a situation in which the target vehicle 10 does not become aware of the pursuing vehicle until it reaches the enable point 22. As described in U.S. Pat. No. 6,006,145, it is normally assumed that a target vehicle 10 will detect the pursuing vehicle 11 at some predetermined range, normally prior to the time the pursuing vehicle 11 enables any active sensors. However, it is also known that activating sensors on the pursuing vehicle will increase the level of sound emanating from the pursuing vehicle 11. In certain tactical environments it is possible for the pursuing vehicle 11 to be outside the alertment range when it activates its sensors. Thus it is possible and even probable, in such a situation that the target vehicle 10 will detect the presence of the pursuing vehicle 11 while it is well beyond the alertment range. Thus, in this scenario, the alertment time that is, enablement time, is known, but the alertment range is not known. In this situation the alertment range is the range that exists between the vehicles 10 and 11 at the time the pursuing vehicle 11 activates its sensors. As shown in FIG. 1, it is assumed that the target vehicle 10 is at location 24 along its track 25 when the pursuing vehicle reaches the enable point 22. At some time after alertment, the target vehicle will begin an evasive maneuver at location 26 to continue on a different track 27.

Figure 2:
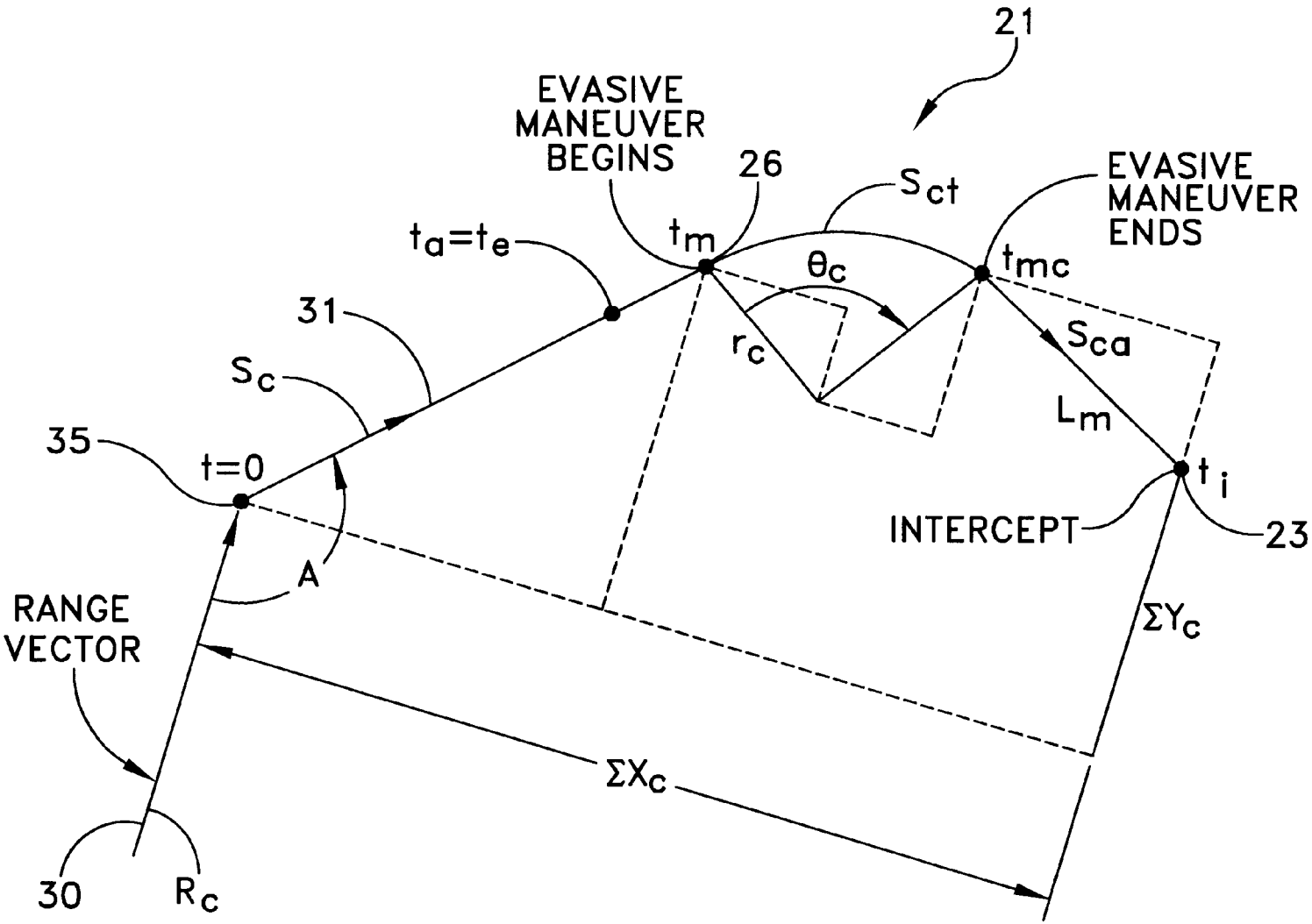
FIG. 2 depicts a generic model for a target vehicle trajectory.

In accordance with this invention, generic models that can be customized for particular events to define each of the paths 14 and 21. FIG. 2 depicts a generic model for a target vehicle 10. At t=0, the launching vehicle 12 establishes a range vector $R_c$ 30 and a target velocity vector 31 extending at an angle A with respect to the range vector 30. The generic path can be defined by a sum of X and Y coordinates representing various positions of the target vehicle 10 over time and with respect to a coordinate system aligned with the range vector 30, e.g., a rectangular coordinate system with the Y axis on the range vector 30 and the 0,0 point at the point 35. These times correspond to particular events designated as $t_e$, $t_m$, $t_{mc}$ and $t_i$. The time, $t_e$, corresponds to the time at which the pursuing vehicle is enabled. Consequently in accordance with this invention, $t_a=t_e$. The time, $t_m$, represents the time of the beginning of an evasive maneuver; the time, $t_{mc}$, the time of the end of that evasive maneuver; and the time, $t_i$, the intercept time. The evasive maneuver can be defined as a fixed radius turn having a radius, $r_c$, and an angle, $\theta_c$. As will be described and as shown in FIG. 1, an angle $\theta_c$ in accordance with this invention will depend, in part, on the direction from which the pursuing vehicle 11 is approaching the target vehicle 10 at the alertment time.

Figure 3:
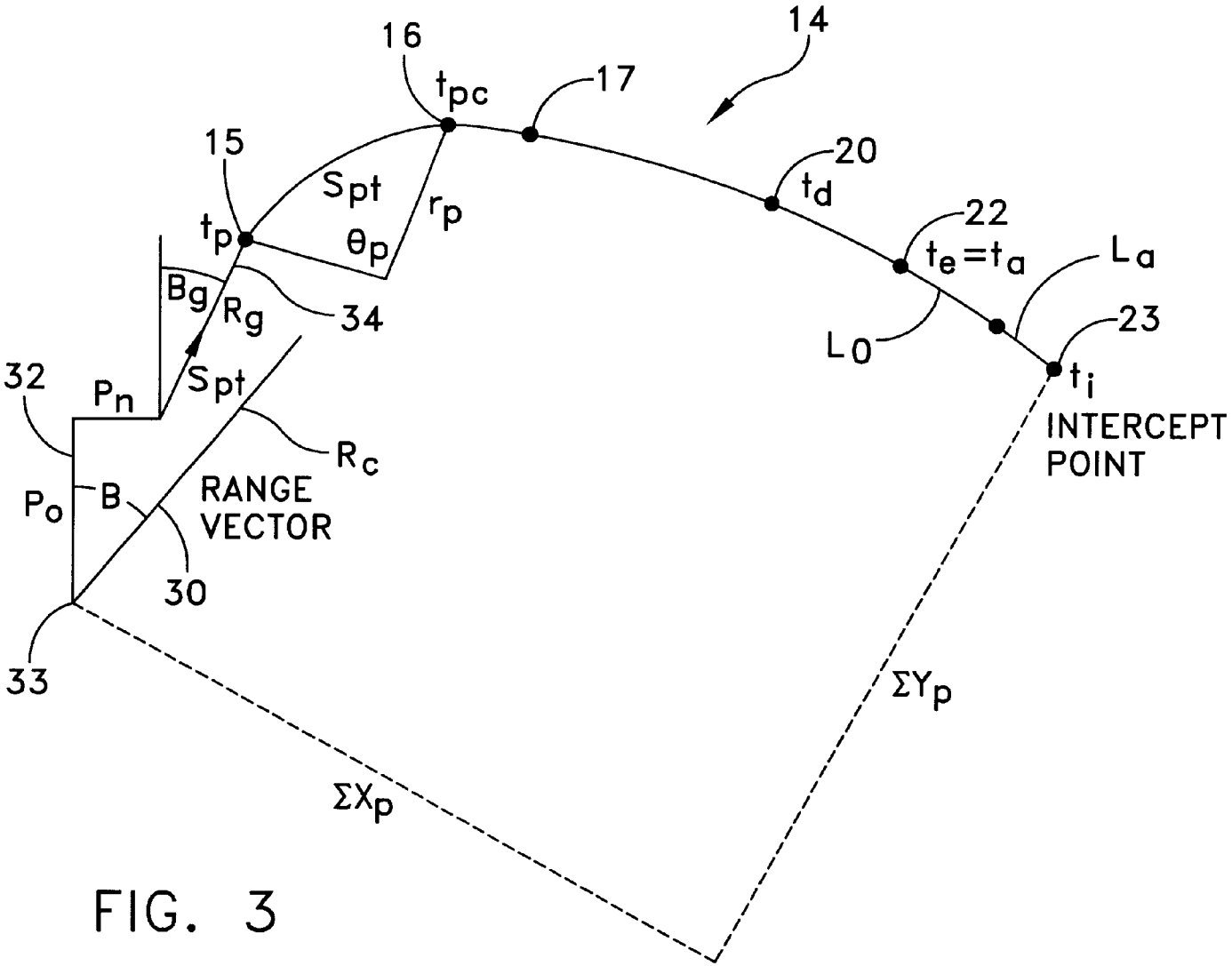
FIG. 3 represents a generic model for a pursuing vehicle trajectory.

After the target vehicle 10 completes an evasive maneuver, it is assumed that the target vehicle continues along a straight-line path at a fixed speed, $S_{ca}$, to the intercept time point 23 at time $t_i$. The distance from the end of the maneuver to intercept is $L_m$. Thus the change in positions from $t_o$ to $t_e=t_a$ along an X axis perpendicular to and across the line of sight represented by the range vector 30 is $-S_c t_e \sin(A)$; along the Y axis in the line of sight axis, the change is $-S_c t_e \cos(A)$. The position change between the alertment time, $t_e$, and the beginning of the evasive maneuver at $t_m$ can be defined as $-S_c(t_m-t_e)\sin(A)$ across the line of sight and $-S_c(t_m-t_e)\cos(A)$ along the line of sight. The evasive maneuver from $t_m$ to $t_{mc}$ can be defined in terms of the radius, $r_c$, and the angle, $\theta_c$, as $r_c \cos(A)-r_c \cos(A-\theta_c)$ across the line of sight and $-r_c \sin(A)+r_c \sin(A-\theta_c)$ along the line of sight. The change in position from the end of the evasive maneuver to the intercept is given by $-L_m \sin(A-\theta_c)$ and $-L_m \cos(A-\theta_c)$ respectively across and along the line of sight. Given the foregoing incremental definitions, the composite generic model path in FIG. 2 for a target vehicle 10 is:

$$\Sigma X_c - S_c t_e \sin(A) - S_c(t_m - t_e)\sin(A) + r_c \cos(A) - r_c \cos(A-\theta_c) - L_m \sin(A-\theta_c) \quad (1)$$

and $$\Sigma Y_e = -S_c t_e \cos(A) - S_c(t_m - t_e)\cos(A) - r_c \sin(A) + r_c \sin(A-\theta_c) - L_m \cos(A-\theta_c) \quad (2)$$

where for $t_i > t_{mc}$, $L_m = S_{ca}(t_i - t_{mc})$ and $\theta_c = \theta_{cm}$.
and where for $t_i \leqq t_{mc}$ $L_m=0$, and $\theta_c = \theta_{cdot}(t_i - t_m)$ FIG. 3 depicts a generic trajectory 14 for the pursuing vehicle 11. It depicts the enablement time, $t_e$, at location 22 and point 23 as the time of intercept, $t_i$. Assuming that the axis 32 of the launching vehicle 12 is vertical in FIG. 3, the range vector 30 to the target has a bearing B relative to that axis 32. Point 33 in FIGS. 1 and 3 indicates the position and reference point of the launching vehicle 12 at the time of launch. In FIG. 3 the distances $P_o$ and $P_n$ define offsets to the center of the torpedo from the reference point of the launching vehicle 12. Segment 34 represents the initial trajectory of the pursuing vehicle 11 for a distance, $R_g$, along an angle, $B_g$, relative to the axis of the launching vehicle. These relationships establish initial launch parameters that coordinate the position of the pursuing vehicle at the start of the gyro turn at point 15 in FIGS. 1 and 3; the parameters are: (1) $P_0 \sin(B) - P_n \cos(E) + R_g \sin(B-Bg)$ across the line of sight, and (2) $P_0 \cos(B) + P_n \sin(B) + R_g \cos(B-Bg)$ parallel to the line of sight. Taking into account the drift rate of the pursuing vehicle, $D_r$, an analysis of the remainder of the generic path 14 shows that the path can be defined by $\Sigma X_p$ and $\Sigma Y_p$ as follows:

$$\begin{aligned}\sum X_p = {} & +P_o\sin(B) - P_n\cos(B) + \\ & R_g\sin(B-Bg) - r_p\cos(B-Bg) + r_p\cos(\theta_p - (B-Bg)) - \\ & S_p(t_d - t_{pc})\sin\left\{\theta_p - (B-Bg) + \left(\frac{D_r}{2}\right)(t_d - t_{pc})\right\} - S_{pd}(t_e - t_d)\sin \\ & \left\{\theta_p - (B-Bg) + D_r(t_d - t_{pc}) + \left(\frac{D_r}{2}\right)(t_e - t_d)\right\} - S_{ps}(t_i - t_e)\sin \\ & \left\{\theta_p - (B-Bg) + D_r(t_d - t_{pc}) + D_r(t_e - t_d) + \left(\frac{D_r}{2}\right)(t_i - t_e)\right\} - \\ & L_a\sin\{\theta_p - (B-Bg) + D_r(t_d - t_{pc}) + D_r(t_e - t_d) + D_r(t_i - t_e)\}\end{aligned} \quad (3)$$

and $$\begin{aligned}\sum Y_p = {} & +P_o\cos(B) + P_n\sin(B) + \\ & R_g\cos(B-Bg) + r_p\sin(B-Bg) + r_p\sin(\theta_p - (B-Bg)) + \\ & S_p(t_d - t_{pc})\cos\left\{\theta_p - (B-Bg) + \left(\frac{D_r}{2}\right)(t_d - t_{pc})\right\} + S_{pd}(t_e - t_d)\cos \\ & \left\{\theta_p - (B-Bg) + D_r(t_d - t_{pc}) + \left(\frac{D_r}{2}\right)(t_e - t_d)\right\} + S_{ps}(t_i - t_e)\cos \\ & \left\{\theta_p - (B-Bg) + D_r(t_d - t_{pc}) + D_r(t_e - t_d) + \left(\frac{D_r}{2}\right)(t_i - t_e)\right\} + \\ & L_a\cos\{\theta_p - (B-Bg) + D_r(t_d - t_{pc}) + D_r(t_e - t_d) + D_r(t_i - t_e)\}\end{aligned} \quad (4)$$

where $r_p$ and $\theta_p$ represent the radius and included angle of the gyro turn by the pursuing vehicle 11 from point 15 to point 16. In these equations, td represents the time at the dive point 20 and $t_e$ the time at the enable point 22. $L_0$ represents a seeker offset or search distance characteristic of a sensory system, such as an acoustic seeker on a torpedo, and $L_a$ represents an acoustic offset distance or guidance distance.

Figure 4:
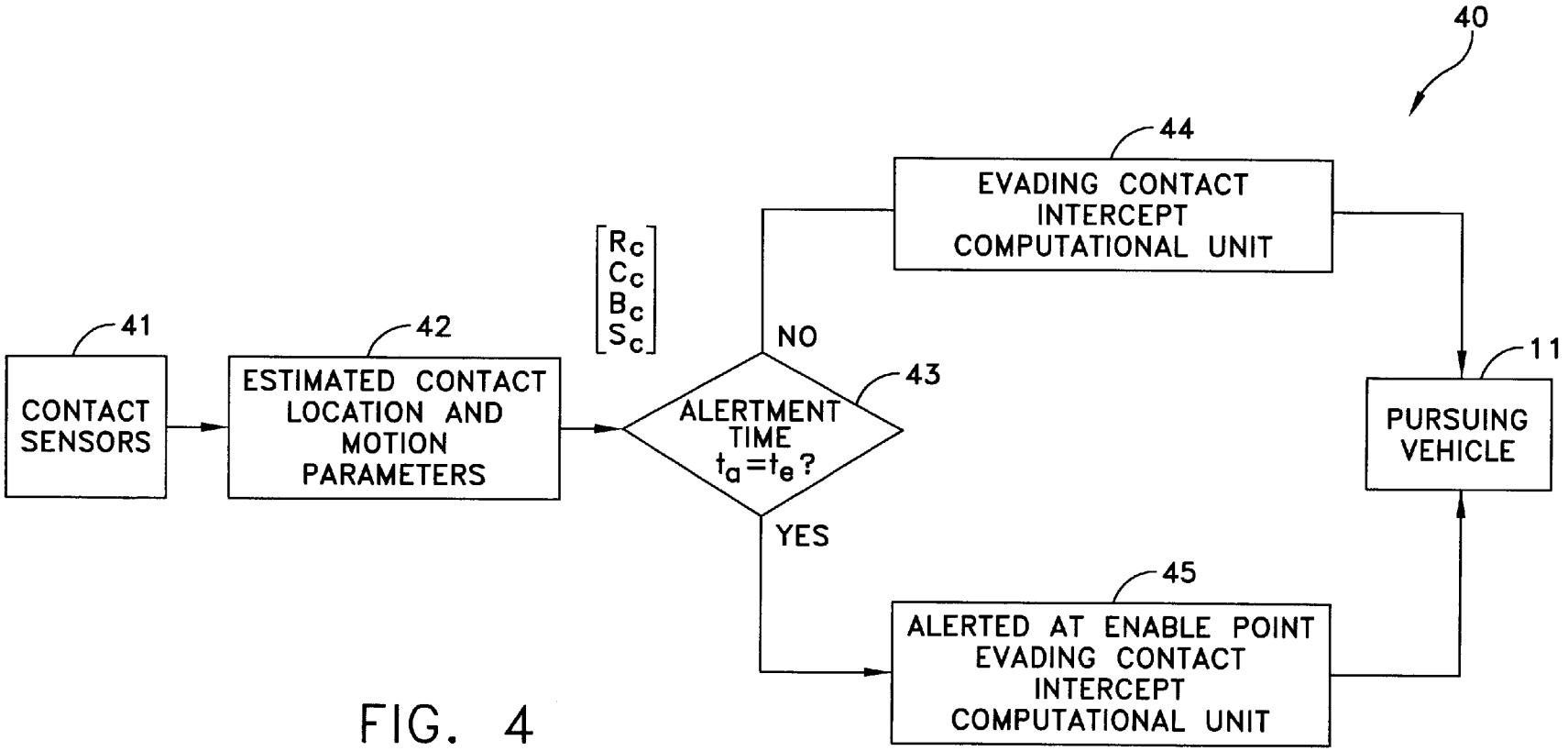
FIG. 4 is a block diagram depicting an evading contact vehicle intercept unit constructed in accordance with this invention.

With the discussion of the trajectories as background, FIG. 4 depicts a system 40 for implementing this invention. Contact sensors 41 and an estimated contact location and motion parameter unit 42 provide the range ($R_c$), course ($C_c$), bearing ($B_c$), and speed ($S_c$) of the contact or target vehicle 10 in FIG. 1. Such units are known in the art.

An alertment time control 43 routes the target vehicle data to an evading contact intercept computational unit 44 if it is anticipated that the target vehicle will detect the presence of the pursuing vehicle after its launch and before its enablement. The unit 44 operates as described in U.S. Pat. No. 6,006,145 and provides data to the pursuing vehicle 11. However, if it is anticipated that the target vehicle will not detect the presence of the pursuing vehicle until it is enabled, the alertment time control 43 transfers the target vehicle data directly to an alerted at enable point evading contact intercept computational unit 45.

the pursuing vehicle and the target vehicle when the target vehicle is alerted at the pursuing vehicle enablement.

More specifically, the range, $R_a$, between points 22 and 24 in FIG. 1 at the time of alertment $t_a=t_e$ constitutes a target vehicle detection range at alertment. Using pre-alertment contact target vehicle and pursuing vehicle trajectory components along the line of sight and across the line of sight as defined by the range vector 30, propagate to enable modules 52 and 54 in the target vehicle model 46 and pursuing vehicle model 50, respectively, provide information to output parameter module 58 in FIG. 5 or other equivalent modules. The output parameter module 58 uses the following relationships to determine the range, $R_a$:

$$R_a^2 = [P_o\sin(B) - P_n\cos(B) + R_g\sin(B-B_g) - r_p\cos(B-B_g) + r_p\cos(\theta_p-(B-B_b)) - S_p(t_d-t_{pc})\sin\left\{\theta_p-(B-B_g)+\frac{D_r}{2}(t_d-t_{pc})\right\} - S_{pd}(t_e-t_d)\sin\left\{\theta_p-(B-B_g)+D_r(t_d-t_{pc})+\frac{D_r}{2}(t_e-t_d)\right\} + S_c t_e\sin(A)]^2 + \left[R_c - S_c t_e\cos(A) - \left\{\begin{array}{c} +[R_c - S_c t_e\cos(A) - P_0\cos(B) + P_n\sin(B) + R_g\cos\left(B-B_g)+\frac{D_r}{2}(t_d-t_{pc}+\right. \\ r_p\sin(\theta_p-(B-B_g)) + S_p(t_d-t_{pc})\cos\left\{\theta_p-(B-B_g)+\frac{D_r}{2}(t_d-t_{pc})\right\} + \\ S_{pd}(t_e-t_d)\cos\left\{\theta_p-(B-B_g)+D_r(t_d-t_{pc})+\frac{D_r}{2}(t_e-t_{pc})\right\} \end{array}\right\}\right]^2 \quad (5)$$

Figure 5:
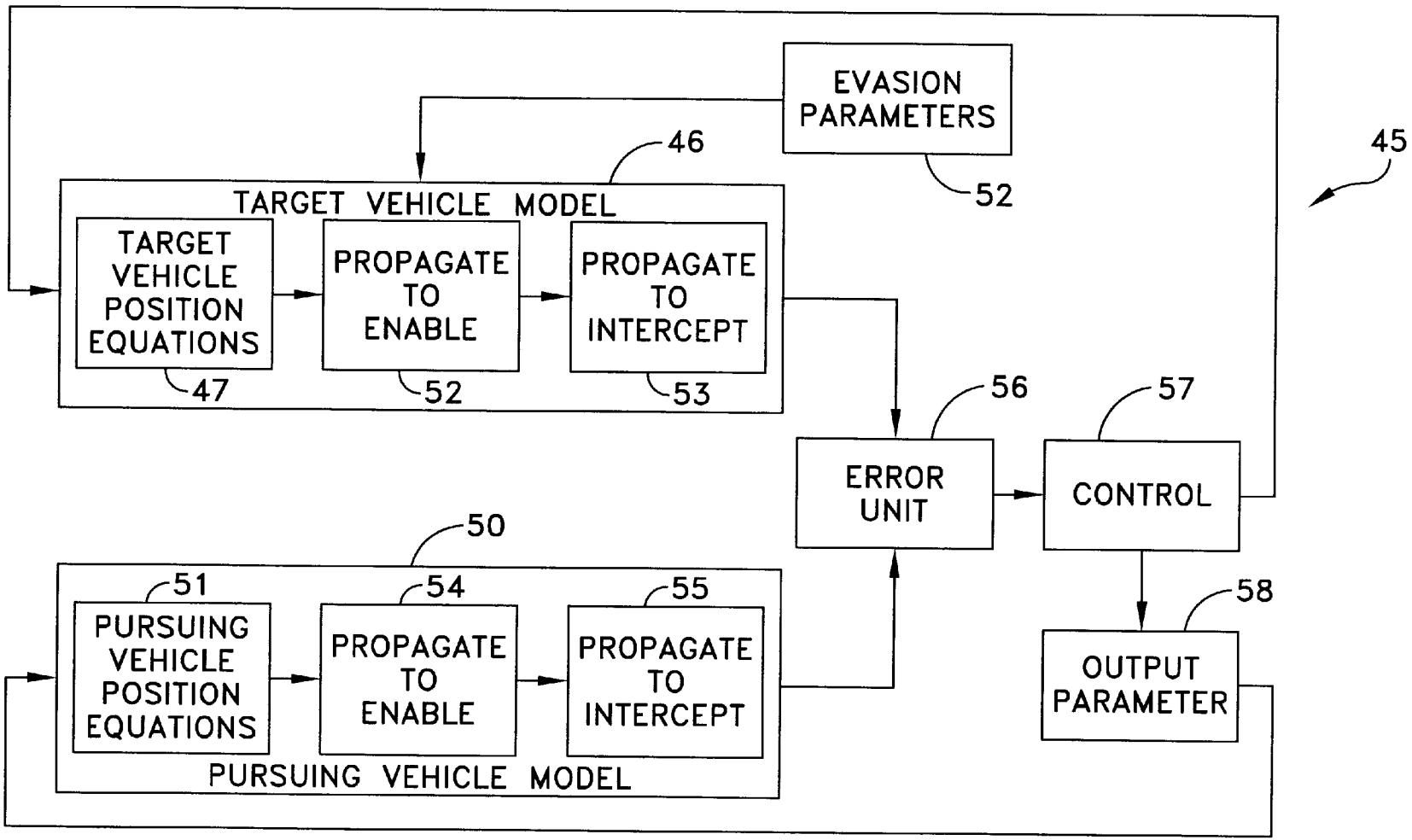
FIG. 5 is a block diagram depicting an alerted at enable point evading target intercept computational unit shown in FIG. 4.

FIG. 5 depicts the computational unit 45 in greater detail. More specifically, the unit 45 includes a target vehicle model 46 that implements position equations (1) and (2). A pursuing vehicle model 50 implements equations (3) and (4). Each of the modules 47 and 51 has the capability, not described in detail but known in the art, for providing particular parameters, such as the turning radius, $r_c$, and rate of turn, $\theta_{cdot}$, shown in FIG. 2. This system also provides for the selection of different values of the evasive angle $\theta_c$ in an evasion parameters module 53. The target vehicle position model 46 uses its position equations module 47, propagate to enable module 52 and propagate to intercept module 53 to generate a representation of an evading target characteristic trajectory based upon the generic model shown in FIG. 2, estimations of the target vehicle state, known characteristics of that target vehicle 10 and, as will be described, estimations of particular maneuvers based upon a particular tactical situation. The pursuing vehicle model 50 uses the pursuing vehicle position equations module 51, propagate to enable module 50 and propagate to intercept module 55 to produce a representation of the pursuing vehicle characteristic trajectory based upon known characteristics of the pursuing vehicle 11 using the generic model shown in FIG. 3.

Errors are formed in the error unit 56 between the across the line of sight positions of contact and pursuer laminar point at intercept, and the along the line of sight positions of the contact and pursuer laminar point of intercept. If the errors are not less than the convergence criteria, they are used by the control unit 57 to determine the next set of updates for the parameters being estimated and are fed back for the next computational cycle.

An output parameter module 58 performs several functions. When a solution is found, the output parameter module provides the output parameter values to the pursuing vehicle. During the processing of a solution the output parameter module 58 may also determine the range between Still referring to FIG. 5, the error unit 56 generates positional errors between the target vehicle and pursuing vehicle at the time of intercept. More specifically, equating the across and along the line of sight components for the target vehicle in equations (1) and (2) and the across and along the line of sight components for the pursing vehicle in equations (3) and (4) yields:

$$\Sigma X_c = \Sigma X_p, \quad (6)$$

$$\text{or } -S_c t_e\sin(A) - S_c(t_m-t_e)\sin(A) + r_c\cos(A) - r_c\cos(A-\theta_c) - L_m\sin(A-\theta_c) = P_o\sin(B) - P_n\cos(B) + R_g\sin(B-Bg) - r_p\cos(B-Bg) + r_p\cos(\theta_p-(B-Bg)) - S_p(t_d-t_{pc})\sin\left\{\theta_p-(B-Bg)+\left(\frac{D_r}{2}\right)(t_d-t_{pc})\right\} - S_{pd}(t_e-t_d)\sin\left\{\theta_p-\left(B-Bg+\left(\frac{D_r}{2}\right)(t_e+t_d-2t_{pc})\right)\right\} - S_{ps}(t_i-t_e)\sin\left\{\theta_p-(B-Bg)+\left(\frac{D_r}{2}\right)(t_i+t_e-2t_{pc})\right\} - L_a\sin\{\theta_p-(B-B_g)+D_r(t_i-t_{pc})\}$$

and $$R_c + \Sigma Y_c = \Sigma Y_p, \quad (7)$$

$$\text{or } R_c - S_c t_e\cos(A) - S_c(t_m-t_e)\cos(A) - r_c\sin(A) + r_c\sin(A-\theta_c) - L_m\cos(A-\theta_c) = P_0\cos(B) + P_n\sin(B) + R_g\cos(B-Bg) + r_p\sin(B-Bg) + r_p\sin(\theta_p-(B-Bg)) + S_p(t_d-t_{pc})\cos\left\{\theta_p-(B-Bg)+\left(\frac{Dr}{2}\right)(t_d-t_{pc})\right\} + S_{pd}(t_e-t_d)\cos\left\{\theta_p-(B-Bg)+\left(\frac{D_r}{2}\right)(t_e+t_d-2t_{pc})\right\} +$$

-continued $$S_{ps}(t_1-t_e)\cos\left\{\theta_p-(B-Bg)+\left(\frac{D_r}{2}(t_1+t_e-2t_{pc})\right)\right\}+$$
$$L_a\cos\{\theta_p-(B-Bg)+D_r(t_i-t_{pc})\}.$$

By inspection of FIGS. 1 through 3 the following relationships exist:

$$t_m=t_e+t_{st}$$

$$t_{mc}=t_e+t_{st}+(r_c(\theta_{cm}))/S_{ct}$$

$$t_{pc}=[R_g+r_p(\theta_p)]/S_{pt}$$

$$t_p=R_g/S_{pt}$$

$$t_{srch}=L_o/S_{ps}$$

$$t_e-t_d=L_d/S_{pd}$$

$$t_{dive}=L_d/S_{pd}$$

$$L_{xr}=P_o\sin(B)-P_n\cos(B)+R_g\sin(B-Bg)$$

$$L_{xc}=r_c\cos(A)-S_ct_{rt}\sin(A)$$

$$L_{yr}=P_o\cos(B)+P_n\sin(B)+R_g\cos(B-Bg)$$

$$L_{yc}=R_c-r_c\sin(A)-S_ct_{st}\cos(A)$$

$$B_1=(B-Bg)$$

$$B_2=(L_o/S_{ps}+L_d/S_{pd})$$

where

- $t_{st}$ represents the reaction time of the target vehicle between alertment at the enablement time, $t_e$, and the beginning of an evasive maneuver $t_m$,
- $s_{ct}$ represents speed of the target vehicle during the evasive turn,
- for $t_{pc}=[R_g+r_p(\theta_p)]/S_{pt}$, $S_{pt}$ equals the speed of the pursuing vehicle 11 during the gyro turn, and
- for $t_p=R_g/S_{pt}$, $S_{pt}$ is the speed with which the pursuing vehicle 11 leaves the launching vehicle 12,
- $L_o$ represents the seeker offset or search distance and $S_{ps}$ equals the speed of the pursuing vehicle in the search phase,
- $L_d$ is the distance of the dive phase beginning at point 20 in FIG. 1, and
- $S_{pd}$ represents the speed of the pursuing vehicle during the dive.

Substituting these relationships in equations (6) and (7) yields positional errors given by:

$$0=L_{xr}-L_{xc}-r_p\cos(B_1)+r_c\cos(A-\theta_c)-S_ct_e\sin(A)+ \tag{8}$$
$$L_m\sin(A-\theta_c)+r_p\cos(\theta_P-B_1)-S_p\left(t_e-\frac{L_d}{S_{pd}}-\frac{R_g+r_p\theta_p}{S_{pt}}\right)$$
$$\sin\left\{\theta_p-B_1+\left(\frac{D_r}{2}\right)\left(t_e-\frac{L_d}{S_{pd}}-\frac{R_g+r_p\theta_p}{S_{pt}}\right)\right\}-$$
$$(L_d)\sin\left\{\theta_p-B_1+\left(\frac{D_r}{2}\right)\left(2t_e-\frac{L_d}{S_{pd}}-2\frac{R_g+r_p\theta_p}{S_{pt}}\right)\right\}-$$

-continued $$S_{ps}(t_i-t_e)\sin\left\{\theta_p-B_1+\left(\frac{D_r}{2}\right)\left(t_i+t_e-2\frac{R_g+r_p\theta_p}{S_{pt}}\right)\right\}-$$
$$L_a\sin\left\{\theta_p-B_1+D_r\left(t_i-\frac{R_g+r_p\theta_p}{S_{pt}}\right)\right\}$$

and $$0=L_{yr}-L_{yc}+r_p\sin(B_1)-r_c\sin(A-\theta_c)-S_ct_e\cos(A)+ \tag{9}$$
$$L_m\cos(A-\theta_c)+r_p\sin(\theta_P-B_1)+S_p\left(t_e-\frac{L_d}{S_{pd}}-\frac{R_g+r_p\theta_p}{S_{pt}}\right)$$
$$\cos\left\{\theta_p-B_1+\left(\frac{D_r}{2}\right)\left(t_e-\frac{L_d}{S_{pd}}-\frac{R_g+r_p\theta_p}{S_{pt}}\right)\right\}+$$
$$(L_d)\cos\left\{\theta_p-B_1+\left(\frac{D_r}{2}\right)\left(2t_e-\frac{L_d}{S_{pd}}-2\frac{R_g+r_p\theta_p}{S_{pt}}\right)\right\}+$$
$$S_{ps}(t_i-t_e)\cos\left\{\theta_p-B_1+\left(\frac{D_r}{2}\right)\left(t_i+t_e-2\frac{R_g+r_p\theta_p}{S_{pt}}\right)\right\}+$$
$$L_a\cos\left\{\theta_p-B_1+D_r\left(t_i-\frac{R_g+r_p\theta_p}{S_{pt}}\right)\right\}$$

There are two ways to define the time, $t_e$, at which an acoustic seeker or other instrumentation or feature is enabled. In one, the time is defined as the time to travel a fixed turn-on distance, $L_{sto}$, from the launch point. In another, the time is defined as the time to travel to the start of search or to a fixed seeker offset distance, $L_o$. If $L_{sto}$ is selected, then $$t_e=\frac{L_{sto}-L_d}{S_p}+\frac{L_d}{S_{pd}}\text{ otherwise} \tag{10}$$

$$t_e=t_i-\frac{L_o}{S_{ps}} \tag{11}$$

The evading target vehicle intercept unit 45 operates in accordance with equations (8)and (9) to generate control updates required to converge to an intercept solution. As previously indicated, these equations are not readily solved because they are transcendental in nature and do not lend themselves to a solution in a closed form. In accordance with this invention, however, initial estimates of operating parameter solutions that characterize a particular trajectory of the pursuing vehicle based upon defined interactions of the representations of the pursuing vehicle and target vehicle trajectories can be produced. Then iterative processing provides successive operating parameter solutions that converge to provide a set of guidance parameters for the pursuing vehicle. In accordance with this invention, the guidance parameters are generated from the numerical solution that exhibits particularly rapid convergence characteristics and accurate estimates.

Expressing equations (8) and (9) as general functions of the problem unknowns and performing a Taylor series expansion yields:

$$e(t_i,\theta_p)=e(t_{i_i},\theta_{p_i})+j\left.\frac{\partial e}{\partial t_i}\right|_i+k\left.\frac{\partial e}{\partial \theta_p}\right|_i+\ldots=0\text{ and} \tag{12}$$

$$f(t_i,\theta_p)=f(t_{i_i},\theta_{p_i})+j\left.\frac{\partial f}{\partial t_i}\right|_1+k\left.\frac{\partial f}{\partial \theta_p}\right|_i+\ldots=0\text{ where} \tag{13}$$

-continued $$\left.\frac{\partial e}{\partial t_i}\right|_i = \partial e \left.\frac{\partial e}{\partial t_i}\right|_{t_i=t_{i_i},\theta_p=\theta_{p_i}} \tag{14}$$

and $$t_i=t_{i_i}+j;\ \theta_p=\theta_{p_i}+k. \tag{15}$$

Neglecting the higher order terms, the solution for this linear set of equations is:

$$j = \frac{e_i C22 - f_i C12}{\Delta} \tag{16}$$

$$k = \frac{f_1 C11 - e_i C21}{\Delta} \text{ and} \tag{17}$$

$$\Delta = C11C22 - C21C12 \tag{18}$$

where $e_i$ and $f_i$ are given by equations (8) and (9)respectively. The partial derivatives are:

$$\begin{aligned} C11 = \frac{\partial e}{\partial t_i} = & \\ & -S_c\left(\frac{\partial t_e}{\partial t_i}\right)\sin(A) + r_c\frac{\partial \theta_c}{\partial t_i}\sin(A-\theta_c) - L_m\frac{\partial \theta_c}{\partial t_i}\cos(A-\theta_c) + \\ & \frac{\partial L_m}{\partial t_i}\sin(A-\theta_c) - S_{ps}(t_i-t_e)\left(\frac{D_r}{2}\right)\left(1+\frac{\partial t_e}{\partial t_i}\right)\cos \\ & \left\{\theta_p - B_1 + \left(\frac{D_r}{2}\right)\left(t_i + t_e - 2\frac{R_g + r_p\theta_p}{S_{pt}}\right)\right\} - S_{ps}\left(1-\frac{\partial e}{\partial t_i}\right) \\ & \sin\left\{\theta_p - B_1 + \left(\frac{D_r}{2}\right)\left(t_i + t_e - 2\frac{R_g + r_p\theta_p}{S_{pt}}\right)\right\} - \\ & L_a(D_r)\cos\left\{\theta_p - B_1 + (D_r)\left(t_i - \frac{R_g + r_p\theta_p}{S_{pt}}\right)\right\} - \\ & S_p\left(t_e - \frac{L_d}{S_{pd}} - \frac{R_g + r_p\theta_p}{S_{pt}}\right)\left(\frac{D_r}{2}\right)\left(\frac{\partial t_e}{\partial t_i}\right)\cos \\ & \left\{\theta_p - B_1 + \left(\frac{D_r}{2}\right)\left(t_e - \frac{L_d}{S_{pd}} - \frac{R_g + r_p\theta_p}{S_{pt}}\right)\right\} - \\ & S_p\left(\frac{\partial t_e}{\partial t_i}\right)\sin\left\{\theta_p - B_1 + \left(\frac{D_r}{2}\right)\left(t_e - \frac{L_d}{S_{pd}} - \frac{R_g + r_p\theta_p}{S_{pt}}\right)\right\} - \\ & L_d D_r\left(\frac{\partial t_e}{\partial t_i}\right)\cos \\ & \left\{\theta_p - B_1 + \left(\frac{D_r}{2}\right)\left(2t_e - \frac{L_d}{S_{pd}} - 2\frac{R_g + r_p\theta_p}{S_{pt}}\right)\right\} \end{aligned} \tag{19}$$

and $$\begin{aligned} C12 = & \\ \frac{\partial e}{\partial \theta_p} = & -r_p\sin(\theta_p - B_1) - S_p\left(t_e - \frac{L_d}{S_{pd}} - \frac{R_g + r_p\theta_p}{S_{pt}}\right)\left(\frac{1 - D_r r_p}{2_{pt}}\right) \\ & \cos\left\{\theta_p - B_1 + \left(\frac{D_r}{2}\right)\left(t_e - \frac{L_d}{S_{pd}} - 2\frac{R_g + r_p\theta_p}{S_{pt}}\right)\right\} + \\ & \left(\frac{S_p r_p}{S_{pt}}\right)\sin\left\{\theta_p - B_1 + \left(\frac{D_r}{2}\right)\left(t_e - \frac{L_d}{S_{pd}} - \frac{R_g + r_p\theta_p}{S_{pt}}\right)\right\} - \\ & (L_d)\left(1 - \frac{D_r r_p}{S_{pt}}\right)\cos \\ & \left\{\theta_p - B_1 + \left(\frac{D_r}{2}\right)\left(2t_e - \frac{L_d}{S_{pd}} - 2\frac{R_g + r_p\theta_p}{S_{pt}}\right)\right\} - S_{ps}(t_i - t_e) \\ & \left(1 - \frac{D_r r_p}{S_{pt}}\right)\cos\left\{\theta_p - B_1 + \left(\frac{D_r}{2}\right)\left(t_i + t_e - 2\frac{R_g + r_p\theta_p}{S_{pt}}\right)\right\} - \\ & L_a\left(1 - \frac{D_r r_p}{S_{pt}}\right)\cos\left\{\theta_p - B_1 + (D_r)\left(t_i - \frac{R_g + r_p\theta_p}{S_{pt}}\right)\right\} \end{aligned} \tag{20}$$

and $$\begin{aligned} C21 = \frac{\partial f}{\partial t_i} = & -S_c\left(\frac{\partial t_e}{\partial t_i}\right)\cos(A) + \\ & r_c\left(\frac{\partial \theta_c}{\partial t_i}\right)\cos(A-\theta_c) + L_m\left(\frac{\partial \theta_c}{\partial t_i}\right)\sin(A-\theta_c) + \\ & \left(\frac{\partial L_m}{\partial t_i}\right)\cos(A-\theta_c) - S_{ps}(t_i - t_e)\left(\frac{D_r}{2}\right)\left(1+\frac{\partial t_e}{\partial t_i}\right)\sin \\ & \left\{\theta_p - B_1 + \left(\frac{D_r}{2}\right)\left(t_i + t_e - 2\frac{R_g + r_p\theta_p}{S_{pt}}\right)\right\} + S_{ps}\left(1 - \frac{\partial t_e}{\partial t_i}\right) \\ & \cos\left\{\theta_p - B_1 + \left(\frac{D_r}{2}\right)\left(t_i + t_e - 2\frac{R_g + r_p\theta_p}{S_{pt}}\right)\right\} - \\ & L_a(D_r)\sin\left\{\theta_p - B_1 + (D_r)\left(t_i - \frac{R_g + r_p\theta_p}{S_{pt}}\right)\right\} - \\ & S_p\left(t_e - \frac{L_d}{S_{pd}} - \frac{R_g + r_p\theta_p}{S_{pt}}\right)\left(\frac{D_r}{2}\right)\left(\frac{\partial t_e}{\partial t_i}\right)\sin \\ & \left\{\theta_p - B_1 + \left(\frac{D_r}{2}\right)\left(t_e - \frac{L_d}{S_{pd}} - \frac{R_g + r_p\theta_p}{S_{pt}}\right)\right\} + \\ & S_p\left(\frac{\partial t_e}{\partial t_i}\right)\cos\left\{\theta_p - B_1 + \left(\frac{D_r}{2}\right)\left(t_e - \frac{L_d}{S_{pd}} - \frac{R_g + r_p\theta_p}{S_{pt}}\right)\right\} - \\ & L_d D_r\left(\frac{\partial t_e}{\partial t_i}\right)\sin \\ & \left\{\theta_p - B_1 + \left(\frac{D_r}{2}\right)\left(2t_e - \frac{L_d}{S_{pd}} - 2\frac{R_g + r_p\theta_p}{S_{pt}}\right)\right\} \end{aligned} \tag{21}$$

and $$\begin{aligned} C22 = \frac{\partial f}{\partial \theta_p} = & r_p\cos(\theta_p - B_1) - \\ & \frac{S_p r_p}{S_{pt}}\cos\left\{\theta_p - B_1 + \left(\frac{D_r}{2}\right)\left(t_e - \frac{L_d}{S_{pd}} - \frac{R_g + r_p\theta_p}{S_{pt}}\right)\right\} - \\ & S_p\left(t_e - \frac{L_d}{S_{pd}} - \frac{R_g + r_p\theta_p}{S_{pc}}\right)\left(1 - \frac{D_r r_p}{2S_{pt}}\right)\sin \\ & \left\{\theta_p - B_1 + \left(\frac{D_r}{2}\right)\left(t_e - \frac{L_d}{S_{pd}} - \frac{R_g + r_p\theta_p}{S_{pt}}\right)\right\} - \\ & (L_d)\left(1 - \frac{D_r r_p}{S_{pt}}\right)\sin \\ & \left\{\theta_p - B_1 + \left(\frac{D_r}{2}\right)\left(2t_e - \frac{L_d}{S_{pd}} - 2\frac{R_g + r_p\theta_p}{S_{pt}}\right)\right\} - \\ & S_{ps}(t_i - t_e)\left(1 - \frac{D_r r_p}{S_{pt}}\right)\sin \\ & \left\{\theta_p - B_1 + \left(\frac{D_r}{2}\right)\left(t_i + t_e - 2\frac{R_g + r_p\theta_p}{S_{pt}}\right)\right\} - \\ & L_a\left(1 - \frac{D_r r_p}{S_{pt}}\right)\sin\left\{\theta_p - B_1 + (D_r)\left(t_i - \frac{R_g + r_p\theta_p}{S_{pt}}\right)\right\} \end{aligned} \tag{22}$$

where for $t_i \geqq t_{mc}$:

$L_m = S_{ca}(t_i - t_{st} - R_c(\theta_{cm})/S_{ct})$, $\partial L_m/\partial t_i = S_{ca}$, $\theta_c=\theta_{cm}$, and $\partial\theta_c/\partial t_i)=0$; and where for $t_i<t_{mc}$:

$L_m=0$, $\partial L_m/\partial t_i=0$;

$\theta_c=\theta_{cdot}(t_i-t_{st})$, $\partial\theta_c/\partial t_i=\theta_c$dot; and where if $L_{sto}$ is selected:

$t_e=(L_{sto}-L_d)/S_p+L_d/S_{pd}$, $\partial t_e/\partial t_i=0$; and where if $L_{sto}$ not selected:

$t_e=t_i-(L_o/S_{ps})$ $\partial t_e/\partial t_i=1$.

Figure 6A:
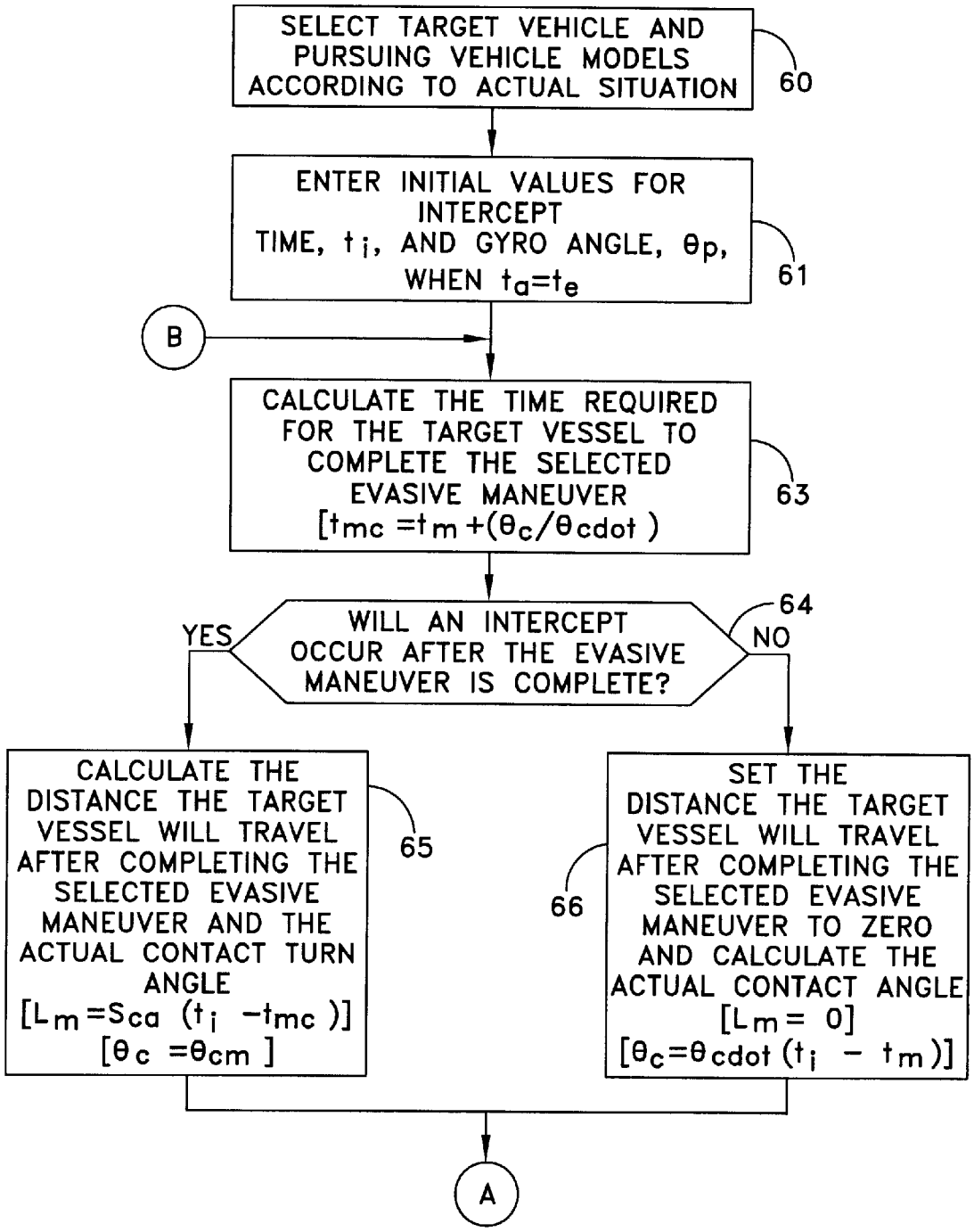
FIGS. 6A and 6B depict the operation of the evading target vehicle intercept unit in FIG. 4 and particularly alerted at enable point evading target intercept computational unit of FIG. 5.
Figure 6B:
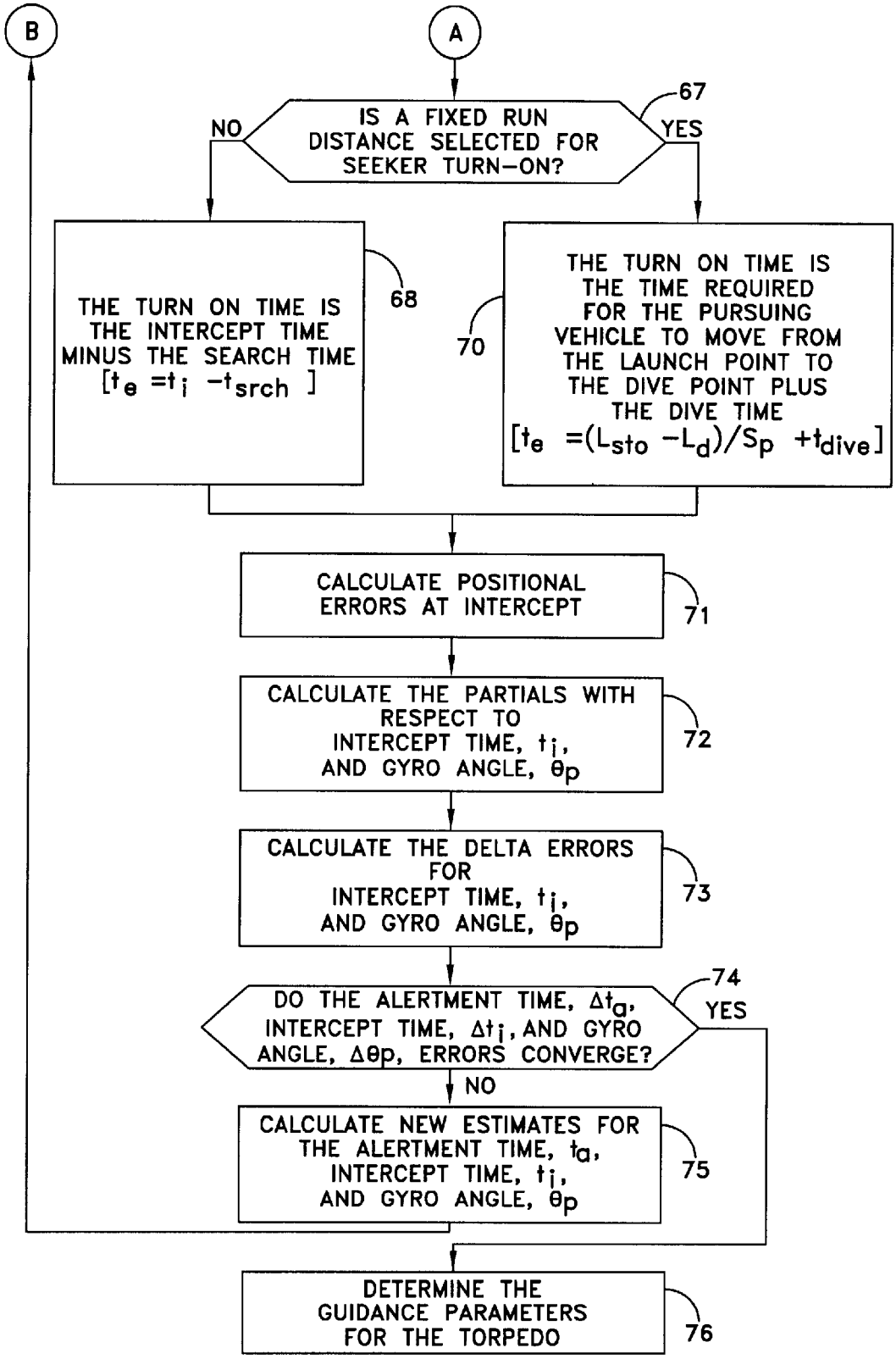

FIGS. 6A and 6B depict an operation of the alerted at enable point evading contact intercept computational unit 45 shown in FIGS. 4 and 5 particularly adapted for applications in which both the launching and target vehicles are submarines and the pursuing vehicle is a torpedo. In this application, primary guidance parameters to be transferred to the torpedo prior to launch include gyro angle and a run to enable computed from a time of enablement, $t_e$ and the time to intercept $t_i$. The launching vessel determines the range, bearing, course and speed of the target ship and normally can classify the target ship based on prior historical information to obtain estimates of other information such as the reaction time, the time delay after the submarine is alerted to the beginning of an evasive maneuver, and the possible evasive maneuvers that might be taken. The evasive maneuver information for each possible maneuver comprises a turn angle $\theta_c$ and radius $r_c$.

For a given tactical situation it also is possible to define particular parameters of the torpedo itself. Consequently in step 60 of FIG. 6A the evading contact intercept computational unit 45 responds to the foregoing and other parameterst select appropriate position equations from the target vehicle position model 46 and the pursuing vehicle model 50 in FIG. 5.

The unit 45 in FIG. 4 then uses the various equations, as previously indicated, to obtain the gyro angle $\theta_p$, the run to enable, $t_e$, and the intercept time, $t_i$, by iteratively processing a series of equations until values of these parameters converge. Step 61 represents the selection of initial or estimated values of these parameters that will be used as initial values for the iterative process. Other more simplified analyses using less sophisticated assumptions about maneuvering can provide initial values. Such values also can be supplied manually.

Step 63 calculates the time for completion of the target ship maneuver, $t_{mc}$, by summing the maneuver start time, tm, and the time to complete the selected evasive maneuver obtained by dividing the maneuver included angle, $\theta_{cm}$, by the predicted angular turn rate, $\theta_{cdot}$. The unit 45 uses step 64 to determine whether the intercept time will occur prior to or after the target vehicle completes an evasive maneuver. If it occurs after, the unit 45 operates according to step 65 to calculate a value, $L_m$, that is the distance from the end of the target ship maneuver to the intercept point based upon the speed of the target vessel after the maneuver is complete, $S_{ca}$, and the time interval between the termination of the maneuver, $t_{mc}$, and the time to the intercept point, $t_i$. Specifically in step 65, the process determines a value for $L_m$ as follows:

$$L_m=S_{ca}(t_i-t_{mc}) \quad 23)$$

The target ship turn angle, $\theta_c$, is not affected, so $\theta_c=\theta_{cm}$.

If, on the other hand, the intercept will occur prior to the completion of the the evasive maneuver, the distance from the end of maneuver to the intercept point, $L_m$, must be zero and the actual target maneuver angle, $\theta_c$, will depend upon the characteristic target turn rate for the evasive maneuver, $\theta_{cdot}$, over the interval that expires between the beginning of the maneuver, $t_m$, and the intercept point, $t_i$. Specifically, in step 66, as previously stated, for example:

$$L_m=0 \quad (24)$$

and $$\theta_c=\theta_{cdot}(t_i-t_m) \quad (25)$$

As previously stated, it is possible to determine the time at which an acoustic seeker turns on by one of two methods. If, in step 67 of FIG. 6B, the unit 45 determines that the enable run is not to be a fixed run distance from launch to seeker turn on, or that $L_{sto}$ is not selected, step 67 diverts to step 68 whereupon the unit 45 in FIG. 4 determines the turn on time, $t_e$, as a function of the intercept time minus a search time, $t_{srch}$, that is one of the input parameters provided in step 60. Specifically:

$$t_e=t_i-t_{srch} \quad (26)$$

This time is based upon the seeker offset distance of a pursuing vehicle with an acoustic seeker or corresponding parameter of another device. If it is desired to turn on the acoustic homing device a predetermined distance after launch, step 67 diverts to step 70 that defines the turn-on time as a function of the distance traveled from launch to dive point ($L_{sto}-L_d$); that is, the predetermined enable distance minus the distance traveled by the torpedo during any dive phase, $L_d$, and the predive speed of the torpedo, $S_p$, and the time required for any diving maneuvers, $t_{dive}$. Specifically:

$$t_e=\frac{L_{sto}-L_d}{S_p}+t_{dive} \quad (27)$$

Next the unit 45 in FIG. 4 executes step 71 thereby to calculate equations (8) and (9) using estimates of problem unknowns to determine position errors at intercept. Step 72 determines the values of the partials using equations (19 through 22). Next the unit 45 uses equations (16) through (18) to solve for errors as delta values, $\Delta t_i$ and $\Delta\theta_p$ in step 73. In this particular embodiment there must be coincident convergence for each of the intercept time and gyro angle values. If these values do not converge, step 74 transfers operation to step 75. Step 75 calculates new estimates for the alertment time, $t_a$, the intercept time, $t_i$ and the gyro angle, $\theta_p$ and transfers operation back to step 63 in FIG. 6A to begin another iteration. When convergence has been achieved, step 74 diverts to step 76 representing the determination and transfer of guidance parameters to the torpedo by means of the output parameter unit 58 in FIG. 5. These parameters include the gyro angle, $\theta_p$, seeker enable time $t_e$, intercept time, $t_i$, and alertment range, $R_a$.

This invention, as previously disclosed, facilitates the computation of solutions for gyro angles, run-to-enable times and intercept times and other pursuing vehicle parameters that undergo multiple speed changes, reaction times, various depth changes, drift and different sensor activation criteria. The formulation of the models and the iterative solution technique presented allow all of these advantages to be achieved in a very rapid manner so that multiple solutions for multiple evasion tactics can be generated rapidly.

It has been found therefore that the process shown in FIGS. 6A and 6B as implemented in the unit 45 in FIG. 4 can reach convergence and can produce valid guidance information for the torpedo in a short interval. More importantly, however, the system also accounts for the responses of a target vehicle when it detects the presence of a pursuing vehicle, such as a torpedo, when the torpedo activates its sensors. The system also accounts for reaction times and various evasion strategies that might be utilized on a more realistic basis. Thus the invention allows the generation of initial guidance parameters for transfer to a pursuing vehicle based upon predicted evasive tactics by a target vehicle based upon expected tactical or actual conditions. This facilitates the effectiveness of launching of a pursuing vehicle, such as a torpedo, without post-launch guidance. It will also be apparent that, while not disclosed with any specificity, the specific processes for performing the specific operations of this invention could be performed on general purpose computers, or on one or more special purpose computers that could be substituted for each of the systems shown in FIGS. 4 and 5. Dedicated hardware and software might also be combined to perform the function of each system in FIGS. 4 and 5.

This invention has been disclosed in terms of certain embodiments. It will be apparent that many modifications can be made to the disclosed organization of apparatus and method without departing from the invention. Therefore, it is the intent of the appended claims to cover all such variations and modifications as come within the true spirit and scope of this invention.

What is claimed is:

1. A control method for directing a pursuing vehicle from a launching vehicle to a target vehicle by supplying to guidance means in the pursuing vehicle operating parameters prior to launching wherein the pursuing vehicle includes means that are enabled after launch and wherein the target vehicle becomes alerted to the presence of the pursuing vehicle when those means are enabled, said method comprising the steps of:

generating a representation of a characteristic trajectory from a generic model of pursuing vehicle trajectory;

generating, in response to data from the identification means, a representation of a characteristic trajectory from a generic model of target vehicle trajectory including the expected enablement range and a plurality of possible evasive actions for the target vehicle;

providing initial values for operating parameters;

iteratively propagating the characteristic trajectories to intercept in response to the initial values of the operating parameters according to a plurality of approximation relationships until the solutions converge and thereafter determining an enablement range from the target vehicle to the pursuing vehicle;

selecting a target vehicle evasive maneuver; and transferring the operating parameters that produce the convergence to the pursuing vehicle guidance means.

2. A control method as recited in claim 1 wherein the operating parameters include for the pursuing vehicle an expected time to intercept, an expected time to enablement and an initial gyro angle.

3. A control method as recited in claim 2 wherein said step of generating representations of the target vehicle trajectory prior to the enablement time includes the steps of determining an initial path of the target vehicle from the target vehicle's position at the time of launching of the pursuing vehicle to the position of the target vehicle at the enablement time.

4. A control method as recited in claim 3 wherein the step of generating the target vehicle trajectory after the enablement time includes the steps of defining a turning movement as a function of an angle, a turning radius and a turning rate.

5. A control method as recited in claim 4 wherein the step of generating the target vehicle trajectory after the enablement time additionally includes continuing the pre-enablement time trajectory for an interval corresponding to a target vehicle reaction time.

6. A control method as recited in claim 4 wherein the step of generating the target vehicle trajectory after the enablement time additionally includes identifying the velocity of the target vehicle and continuing the target vehicle on the post-enable trajectory from the completion of the turn to the intercept point.

7. A control method as recited in claim 1 wherein the launching, pursuing and target vehicles are constituted respectively by a submarine, a torpedo with a guidance gyro and instrumentation to be enabled after the launch in response to parameters including an initial setting for gyro angle, a run-to-enable time that represents the interval from the launch time to the time at which the instrumentation is to be activated and an intercept time, and a target vessel with alertment means for detecting the presence of the pursuing vehicle at the pursuing vehicle's time of enablement and said step of generating initial values of predetermined operating parameters including the step of providing initial values of the run-to-enable time, intercept time and gyro angle.

8. A control system for directing a pursuing vehicle from a launching vehicle to a target vehicle by supplying, to guidance means in the pursuing vehicle, guidance parameters prior to launching wherein the launching vehicle includes identification means for establishing predetermined target vehicle operating characteristics, the pursuing vehicle including active sensor means that are activated at the run-to-enable time and the target vehicle becoming alerted to the pursuing vehicle only at the run-to-enable time, said control system comprising:

means for generating a representation of a characteristic trajectory from a generic model of pursuing vehicle trajectory;

means for generating, in response to data from the identification means, a representation of a characteristic trajectory from a generic model of target vehicle trajectory including a plurality of evasive maneuvers;

means for providing initial values for the operating parameters;

means for iteratively propagating the characteristic trajectories in response to the initial operating parameters according to a plurality of approximation relationships until the solutions converge, means for determining the enablement range from the target vehicle to the pursuing vehicle at the run-to-enable time and means for determining course changes as a result of an evasive maneuver; and means for transferring the operating parameters that produce the convergence to the pursuing vehicle guidance means.

9. A control system as recited in claim 8 wherein iterative propagating means includes error means for comparing the differentials of the predetermined operating parameters generated during successive iterations to determine whether each of the operating parameters meet predetermined convergence criteria.

10. A control system as recited in claim 8 wherein the launching, pursuing and target vehicles are constituted respectively by a submarine, a torpedo with a guidance gyro and active sensor instrumentation to be enabled after the launch, and target submarine that is expected to detect the presence of the pursuing vehicle only when the active sensor instrumentation has been enabled, wherein the transferred guidance parameters include an initial setting for gyro angle, a run-to-enable time that represents the interval from the launch time to the time at which the instrumentation is to be activated and an intercept time at which the torpedo reaches the target submarine.

11. A control system as recited in claim 10 wherein the launching submarine includes means for determining a range vector to the target ship at the time of launch and said control system generating means determines various positions on a coordinate system aligned with the range vector.

12. A control system as recited in claim 10 wherein said iterative propagating means includes error means for comparing successive solutions for the time of intercept and torpedo gyro angle.

13. A control system as recited in claim 10 wherein said iterative propagating means includes error means for comparing successive values at the end of an iteration and enabling the transfer of guidance values when each of the comparisons is within a predetermine range.

14. A control system as recited in claim 10 wherein said representation of target vehicle trajectory includes, for the target submarine, a reaction time, turn angle and speed, said propagating means including means for incorporating the evasive action defined.

* * * * *